US006442939B1

(12) United States Patent
Stuttaford et al.

(10) Patent No.: US 6,442,939 B1
(45) Date of Patent: Sep. 3, 2002

(54) DIFFUSION MIXER

(75) Inventors: Peter Stuttaford; Stephen Oliver Oikawa, both of Toronto; David Edwin Cowburn, Oakville, all of (CA)

(73) Assignee: Pratt & Whitney Canada Corp., Quebec (CA)

( * ) Notice: Subject to any disclaimer, the term of this patent is extended or adjusted under 35 U.S.C. 154(b) by 41 days.

(21) Appl. No.: 09/742,009

(22) Filed: Dec. 22, 2000

(51) Int. Cl.[7] ..... F02C 3/00; F23R 3/40
(52) U.S. Cl. ..... 60/737; 60/723; 60/746
(58) Field of Search ..... 60/737, 746, 747, 60/723, 751

(56) References Cited

U.S. PATENT DOCUMENTS 3,299,632 A * 1/1967 Wilde et al. ..... 60/746
3,618,319 A * 11/1971 Kydd ..... 60/737
4,455,840 A * 6/1984 Matt et al. ..... 60/737
4,845,952 A 7/1989 Beebe
5,161,366 A 11/1992 Beebe
5,452,574 A 9/1995 Cowell et al.
5,765,363 A * 6/1998 Mowill ..... 60/737
5,826,429 A 10/1998 Beebe et al.

* cited by examiner

*Primary Examiner*—Ted Kim
(74) *Attorney, Agent, or Firm*—Bachman & LaPointe, P.C.

(57) ABSTRACT

A premixer for an industrial type gas turbine engine wherein the premixer includes a diffuser ring assembly made up of annular concentric rings and upstream of the diffuser ring assembly in the airflow path is a corresponding fuel manifold ring assembly, each ring in the manifold ring assembly corresponding to a passageway formed between the diffuser rings, and each manifold ring includes a downstream channel for feeding the fuel to the air as the air passes by the ring.

7 Claims, 3 Drawing Sheets

DIFFUSION MIXER

BACKGROUND OF THE INVENTION

1. Field of the Invention

The present invention relates to gas turbine engines, and more particularly, to an air/fuel mixer for a combustor. The type of gas turbine engine may be used in power plant applications.

2. Description of the Prior Art

Low $NO_x$ emissions from a turbine engine, of below 10 volume parts per million (ppmv), are becoming important criteria in the selection of turbine engines for power plant applications. The current technology for achieving low $NO_x$ emissions may involve a combination of a catalytic combustor with a fuel/air premixer. This technology is known as Dry-Low-Emissions (DLE) and offers a prospect for clean emissions combined with high engine efficiency. The technology relies on a higher air content in the fuel/air mixture.

However, flame stability decreases rapidly at these lean combustion conditions, and the combustor may be operating close to its blow-out limit. In addition, severe constraints are imposed on the homogeneity of the fuel/air mixture since leaner than average pockets of mixture may lead to stability problems, and richer than average pockets will lead to unacceptable high $NO_x$ emissions. The emission of carbon monoxide as a tracer for combustion efficiency will increase at leaner mixtures for a given combustor due to the exponential decrease in chemical reaction kinetics. Engine reliability and durability are of major concern at lean combustion conditions due to high pressure fluctuations enforced by flame instabilities in the combustor.

In a DLE system, fuel and air are premixed prior to injection into the combustor, without diluant additions, aligned for significantly lower combustion temperatures, therefore minimizing the amount of nitrogen oxide formation. However, two problems have been observed. The first is the stability or engine operability which provides decreasing combustion efficiency and, therefore, high carbon monoxide emissions. The stability of the combustion process rapidly decreases at lean conditions because of the exponential temperature dependence of chemical reactions. This can lead to flame-out and local combustion instabilities which change the dynamic behavior of the combustion process, and endangers the mechanical integrity of the entire gas turbine engine. At the same time, a substantial increase in carbon monoxide and unburned hydrocarbon (UHC) emissions is observed, and a loss in engine efficiency can be found under these circumstances.

It has been found that a key requirement of a successful DLE catalytic combustion system is the reaction of a perfectly mixed gaseous fuel and air mixture that is less than 1% variation in mixture fraction. Constraints on the system include less than a 1% pressure drop across the mixer. It is also important to develop a flow which will not generate flash-back or auto-ignition of the combustible fuel/air mixture.

SUMMARY OF THE INVENTION

It is an aim of the present invention to provide a diffusion gas mixture which is capable of providing a fuel/air mixture with less than 1% variation.

It is a further aim of the present invention to provide a gas mixer that has a pressure drop of below 1% while reducing the risk of auto-ignition and flash-back.

A construction in accordance with the present invention comprises a fuel/air premixer for a gas turbine combustor, wherein the premixer comprises an annular diffuser assembly placed in the airflow path, upstream of an inlet to the combustor, the diffuser assembly having an upstream section and a downstream section relative to the airflow path and including a plurality of concentric rings wherein a diffuser passageway is formed between each adjacent ring in a pair of rings; the passageway so formed including a converging cross-sectional portion at the upstream section of the ring assembly and a diverging cross-sectional portion at the downstream section of the ring assembly, and a gap is defined at the narrowest part of the passageway formed by the adjacent rings; and an assembly of concentric fuel manifold rings is provided upstream of the diffuser assembly whereby each manifold ring is located in axial alignment with a corresponding diffuser passageway whereby the air flows around the manifold rings and through the diffuser passageways, and fuel is delivered from the manifold rings into the airflow.

In a more specific embodiment of the present invention, the gap defined between the diffuser rings is determined by the formula $M=ACd\sqrt{2\rho\Delta P}$, where M is the mass flow, ACd is the effective flow area, $\rho$ is density of the air, and $\Delta P$ is the pressure drop.

A feature resulting from the present invention is that the fuel is drawn into the airflow since the fuel is fed at very low pressures. Thus, the fuel is not being mixed into the airflow as in typical fuel nozzles where the fuel is fed under high pressure and relies on the fuel momentum for mixing, but instead it is the flow of the air around the manifold rings which draws the fuel and the air is mixed into the fuel. This method is very effective since more than 95% of the fluid is air and it is the air that is doing the work.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
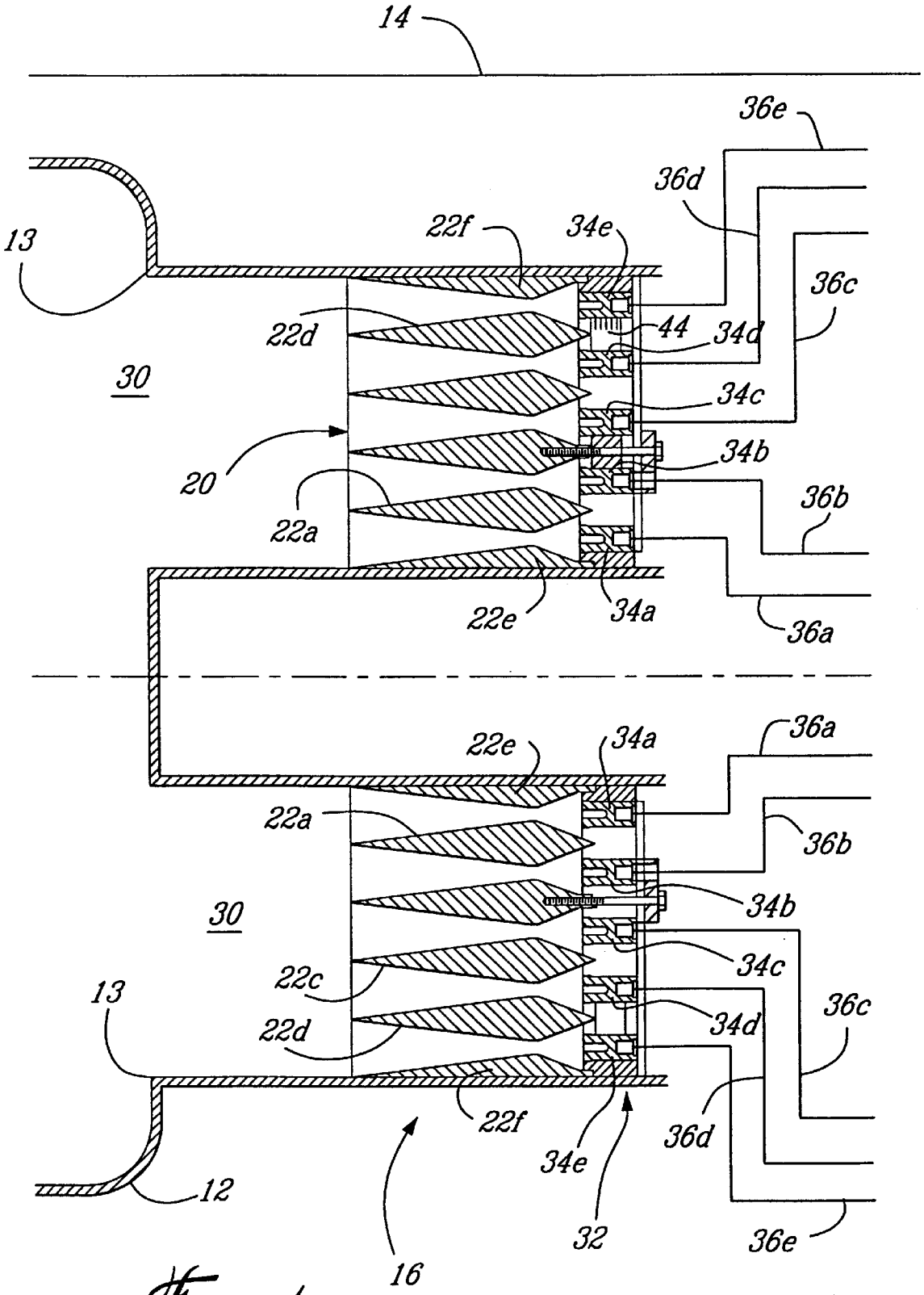
FIG. 1 is a schematic axial cross-section of a combustor system in accordance with the present invention.
Figure 2:
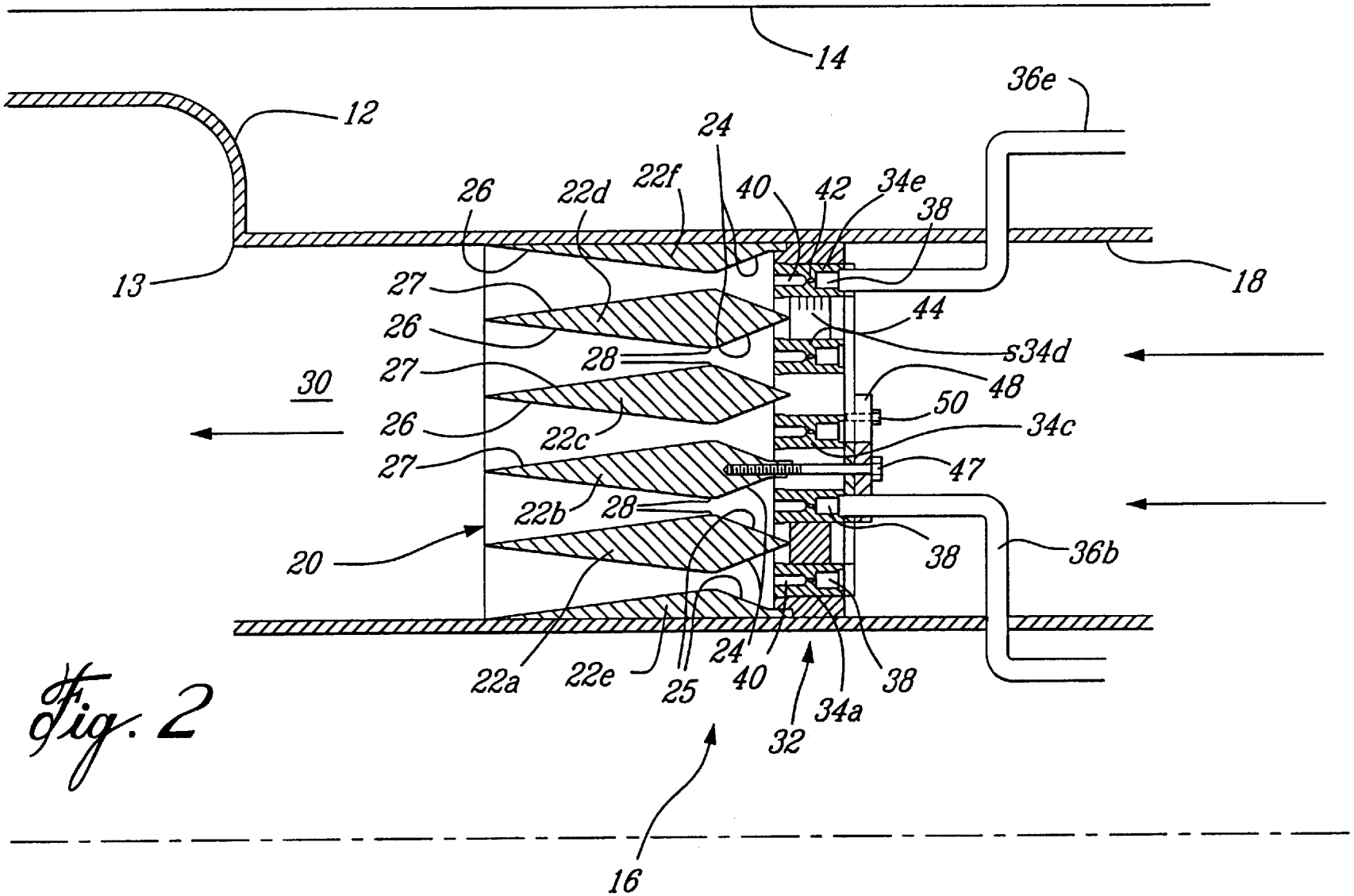
FIG. 2 is an enlarged fragmentary axial cross-section of a portion of the premixer portion.

Referring now to the drawings and particularly to FIG. 1, the combustor system 10 is shown with a combustion chamber 12 within an engine casing 14. The compressed air flow, in the present embodiment, moves from right to left in FIG. 1 in the direction of the inlet 13 of the combustion chamber 12. A fuel/air premixer 16 is provided within the housing 18, defining the passageway of the airflow. A plurality of premixers may be provided for a single combustion chamber 12 with a premixer corresponding to each inlet 13 of the combustion chamber 12. FIGS. 1 and 2 show in detail the structure of the premixer 16.

The premixer 16 includes a diffuser ring assembly 20 made up of concentric diffuser rings which are identical in cross-section. In the present case, there are four diffuser rings 22*a* to 22*d*. On the inner and outer walls of the housing 18, half diffuser rings 22*e* and 22*f* are provided. Each diffuser ring defines, with an adjacent concentric diffuser ring 22, a diffusing passageway made up of converging surfaces 24 and 25, in the upstream portion of the diffuser ring assembly 20, and diverging diffuser ring surfaces 26 and 27, in the downstream portion. Thus, a cross-section of the diffuser ring 22 is somewhat of an elongated quadrilateral in the form of two isosceles triangles with a common base at the widest portion of the ring. The widest portion of each diffuser ring 22 defines a gap 28 with an adjacent annular ring. There is no limit to the number of diffuser rings 22 which might be used as a ring assembly.

The degree of homogeneous mixing of the fuel/air mixture, as will be described, is dependent on the length of the downstream passageway mixing area 30. Since this area is limited, the angle and length of the divergent surfaces 26 and 27 can be adjusted.

Figure 3:
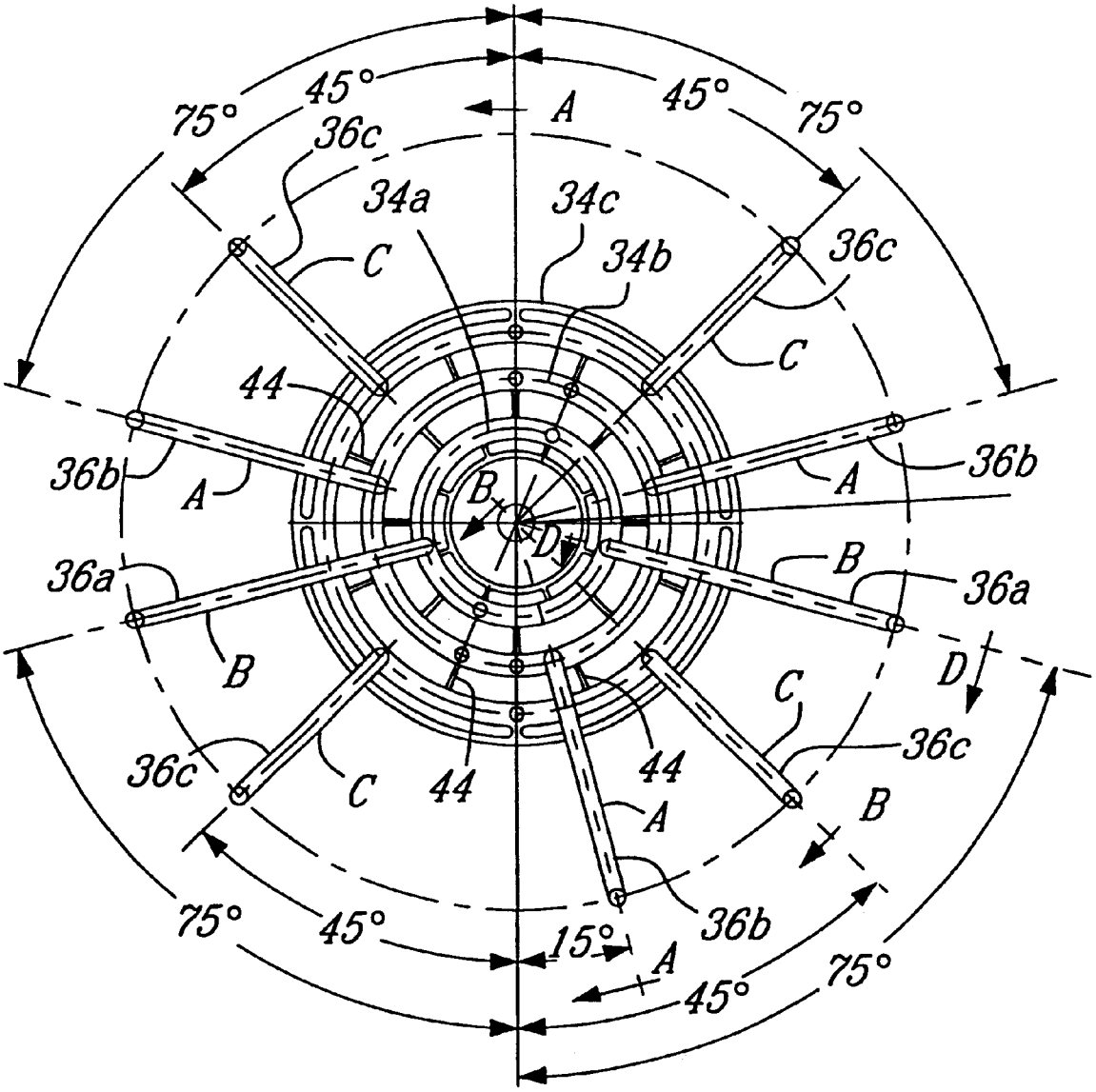
FIG. 3 is an end elevation taken upstream of another embodiment of the premixer.

As can be seen in FIGS. 2 and 3, there is a manifold assembly 32 upstream of the diffuser assembly 16. Each of these annular manifold rings 34*a* to 34*e* is provided with individual fuel supply pipes 36*a* to 36*e*. In FIG. 3, only three rings, namely, rings 34*a*, 34*b*, and 34*c*, are shown, but these are representative of the five rings 34*a* to 34*e* which can be provided in the apparatus.

As shown in FIG. 2, each of the manifold rings 34*a* to 34*e* includes a fuel chamber 38 which extends throughout the manifold. Each ring 34 defines a channel 40 in a downstream portion thereof. Tangential openings 42 extend between the chamber 38 and the channel 40 to permit the fuel to flow through from the chamber 38 into the channel 40. The fuel is fed in gaseous form through the pipes 36*a* to 36*e* into the fuel chamber 38 of each ring 34*a* to 34*e*, and the fuel is then distributed into the channel 40 of each ring tangentially, such that there is a circular component to the flow of the gaseous fuel in the channel 40. The fuel advances along the walls of the channel 40 to be sheared at the edges of the manifold ring 34 at 41 where the fuel is mixed by the air passing around the manifold rings 34 in the passageway and towards the area formed by converging surfaces 24 and 25 of the diffuser rings 22.

A similar construction could be used for liquid fuel, but the air would then be under a higher pressure drop.

The fuel/air mixture passes through the constrained gaps 28 and then is diffused as the diverging surfaces 26 and 27 of the diffuser rings 22 spread out, causing the homogeneous mix of the fuel and the air. As the mixture advances through the diffusion area 30, downstream of the diffuser assembly, the mixing of the fuel and air is completed prior to passing through the inlet 13 into the combustion chamber 12.

The shape and location of the diffuser rings 22 cause the fuel and air mixture to accelerate through the converging portion in the upstream portion of the diffuser assembly 20, minimizing the risk of flash-back and auto-ignition. The aerodynamic diffusion accelerates the natural chemical diffusion of the mixture. The mixture was analytically demonstrated to have a mix with a variation of less than 1% throughout the area downstream of the diffuser assembly area 30 downstream of the diffuser assembly. The fuel is fed at low pressure. A pressure drop of below 1% was realized on the airflow across the inlet.

Depending on the size of the engine to which the premixer is to be adapted, the dimensions of the plates and particularly the gap size 28 might vary. To determine the gap area, the following formula should be followed:

$$M=ACd\sqrt{2\rho\Delta P}$$

wherein M=mass flow

ACd=effective flow area

ρ=density of the air

ΔP=pressure drop

As previously mentioned, the diffusion of the mixing gases can be adjusted by varying the angles of the converging and diffusing surfaces 24, 25, 26, and 27.

The manifold assembly 32 made up by the manifold rings 34*a* to 34*e* is mounted within the housing, and the concentric rings 34*a* to 34*e* are mounted together by means of fins 44 which are staggered at 90° in order to cause the least amount of drag on the air flow. These fins can be seen in FIG. 3.

The diffuser assembly 20 is placed downstream of the manifold assembly 32. Each diffuser ring 22*a* to 22*d* is individually mounted to the manifold assembly by means of elongated bolts 46 and brackets 48 as seen in FIG. 2. Each bolt 46 has a bolt head 47. The bracket 48 includes further bolts 50 which can be screwed onto the manifold rings.

A catalyst (not shown) may be provided in the area 30 downstream of the diffuser ring assembly.

We claim:

1. A fuel/air premixer for a gas turbine combustor wherein the premixer comprises an annular diffuser assembly placed in the airflow upstream of an inlet to the combustor, the diffuser assembly including a plurality of concentric rings wherein a diffuser passageway is formed between each adjacent ring in a pair of rings; the diffuser assembly has an upstream section and a downstream section relative to the airflow; the passageway formed by a pair of adjacent rings includes a converging cross-sectional area at the upstream section of the diffuser assembly and a diverging area at the downstream section of the diffuser assembly and a gap defined at the narrowest part of the passageway between the upstream and downstream sections; an assembly of concentric fuel manifold rings is located upstream of the diffuser assembly whereby each manifold ring is located in axial alignment with a corresponding diffuser passageway whereby the air flows around the manifold rings and through the corresponding diffuser passageways, and fuel is delivered into the airflow from the manifold rings.

2. The premixer as defined in claim 1, wherein the gap in the passageway is determined by $M=ACd\sqrt{2\rho\Delta P}$, where M is the mass flow, ACd is the effective flow area, ρ is density of the air, and ΔP is the pressure drop.

3. The premixer as defined in claim 1, wherein the manifold rings each include a fuel chamber extending throughout the manifold ring on the upstream side thereof, and a separate open axial channel is formed on the downstream side of the ring and a tangential bore extends between the fuel chamber and the channel in order to feed the fuel from the chamber to the channel.

4. The premixer as defined in claim 3, wherein at least one individual fuel pipe is connected to each individual manifold ring and communicates with the manifold fuel chamber.

5. The premixer as defined in claim 4, wherein radial spaced-apart fins extend between each manifold ring in order to support the ring assembly.

6. The premixer as defined in claim 1, wherein each of the diffuser rings is in the form of a quadrilateral having an isosceles triangle shaped upstream portion defining a pair of flared surfaces forming the converging passageway with adjacent rings, and a second isosceles triangle extending in the downstream direction on a common base with the first isosceles triangle of a quadrilateral shaped ring.

7. The premixer as defined in claim 1, wherein the fuel is a gaseous fuel fed at a low pressure drop and the gaseous fuel is drawn into the airflow at the channel.

* * * * *